United States Patent [19]

van der Scheer

[11] Patent Number: 4,562,320

[45] Date of Patent: Dec. 31, 1985

[54] CURRENT-LIMITING DEVICE

[75] Inventor: Derk van der Scheer, Goor, Netherlands

[73] Assignee: Hazemeijer B.V., Hengelo, Netherlands

[21] Appl. No.: 216,498

[22] Filed: Dec. 15, 1980

Related U.S. Application Data

[63] Continuation of Ser. No. 818,330, Jul. 22, 1977.

[51] Int. Cl.[4] ..... H01H 33/00; H01H 9/30

[52] U.S. Cl. ..... 200/144 R; 200/146 R; 200/144 AP

[58] Field of Search ..... 200/144 AP, 144 R, 146

*Primary Examiner*—Robert S. Magon

*Attorney, Agent, or Firm*—Watson Cole Grindle & Watson

[57] ABSTRACT

Electric current is limited in a current interruption device including two stationary contacts with terminals and a bridging contact movable toward and away from a position bridging the stationary contacts by a conductor connected to each of the stationary contacts and an interconnection of the ends of the conductors remote from the stationary contacts to provide a parallel current path other than the current path for the arc with the current being interrupted when the bridging contact moves away from its bridging position at a value of the current flowing through the conductors such that upon interruption of the current therethrough the voltage across the stationary contacts is sufficient to generate an arc therebetween with the arc travelling along the conductors away from the stationary contacts by the magnetic field generated from the current flowing through the conductors.

6 Claims, 2 Drawing Figures

CURRENT-LIMITING DEVICE

This is a continuation of application Ser. No. 818,330 filed July 22, 1977.

BACKGROUND

1. Field of the Invention

This invention relates to a device for limiting electric current, the device comprising two stationary contacts, provided with current-connecting means, as well as a third contact, movable towards and away from the two stationary contacts, in which each of the two stationary contacts is provided with a conducting member such that when electric current flows through the device, the arc, formed after the movable contact has moved away from the two stationary contacts, will be carried away with the arc roots travelling along the conducting members of the stationary contacts under the influence of the magnetic field generated by the current. A device of this kind has been described in Dutch patent application No. 75.03925 as well as British Pat. No. 1,499,486.

2. Prior Art

With the known devices for limiting current, the free ends of the conducting member extending from the stationary contacts are each connected with an annular electrode, the electrodes as well as the conducting members being separated from each other. When the movable contact of the known device is withdrawn from the stationary contacts and the arc thus formed will travel downwards with the arc roots along the conducting members of the stationary contacts, the travelling arc will gradually introduce additional impedance in an electric circuit, which is serially connected to the device, whereby the current flowing in the electric circuit will be reduced as well as the arc energy, so that the arc will be quenched eventually. In the known device, the gradual introduction of additional impedance in the electric circuit and the subsequent interruption of the current in the electric circuit form an inextricable combination with each other.

SUMMARY OF THE INVENTION

It is the object of the present invention not to have the gradual introduction of additional resistance automatically followed by the interruption of the electric current flowing through the device and to that end, a device of the following kind is provided. The device is characterized in that the movable contact is driven by an electromechanical release mechanism, that mechanism being set at a value of the current flowing through the device such that the voltage remaining across the stationary contacts after the withdrawal of the movable contact is sufficient to have an arc formed. The ends of the conducting members facing away from the stationary contacts are connected to an end member, which, during the formation of the arc and its subsequent movement along the conducting members, the ends of the conducting members facing away from the stationary contacts are electrically connected with each other by the end member.

By this invention as soon as the arc has been quenched, the current itself flowing through the device has not been interrupted yet, as the current, which has been reduced as a consequence of the additional resistance introduced into the electric circuit, is maintained through the end member which electrically connects the conducting member ends facing away from the stationary contacts. The current may then be interrupted at any time after the quenching of the arc by a switch which is serially connected with the device. The device according to the present invention may be included in a current-distributing system comprising several serially connected switches—in which all switches under the influence of a flowing overload current may interrupt independently that overload current after a certain response time which can be preset, and in which, according to the known, so-called selectivity principle, the preset response times of the respective switches are in relation with each other such that the switch which, seen from the current source, is nearest to the overload, will interrupt the overload current and the other switches will remain closed. Thus, the advantage is obtained that, when at least the response time of the device is chosen such that the arc is quenched before the switch, which according to the selectivity principle will interrupt the overload current, the device according to the invention will reduce the overload current by introducing additional resistance into the electric circuit as a result of which the circuit-breaking capacity of each of the switches can to be lower than when the device according to the invention had not been connected in series with the switches. As a result the switches may be less expensive and more compact. Thus, only one device in accordance with the present invention is required to effect the circuit-breaking capacity of all switches connected in series with the device at the side of the device facing away from the source of current needs to be comparatively low.

A first embodiment of the present invention is characterized in that the end member is a stationary through-connection. As has been indicated, the current flowing through the device will be interrupted by a switch serially connected with the device, after the arc in the device has been quenched and, thus, additional resistance has been introduced into the electric circuit whereby the current has been reduced.

A second embodiment of the device according to the present invention is characterized in that the end member is an interrupter. When the movable contact of the device according to the invention electrically connects the two stationary contacts with each other, the current will flow mainly through the system constituted by the two stationary contacts and the movable contact, and an insignificant part of the current flows through the conducting members and the end member electrically connecting the ends of the conducting members, i.e. the interrupter.

Consequently, the interrupter need not have the capacity for conducting the continuous nominal current flowing through the system of stationary and movable contacts.

In accordance with a modification of the second embodiment, the interrupter is an electrical switch, whereas in accordance with another modification the interrupter is an electric safety fuse.

When an electrical switch is used as the interrupter, that element may be of comparatively simple construction, since it need not have the capacity for conducting the continuous nominal current and it should only be capable of carrying the reduced overload current for a very short period of time and to effect the subsequent interruption of same.

When an electric safety fuse is used as the interrupter, the fuse may be of the type which is only capable of interrupting a reduced overload current after having carried the same for a short period; thus, the safety fuse need not be designed so as to be capable of carrying nominal current continuously.

BRIEF DESCRIPTION OF THE FIGURES

The invention will now be described more in detail with reference to the FIGS. 1 and 2 representing the first and the second embodiment of this invention, respectively.

DETAILED DESCRIPTION

Figure 1:
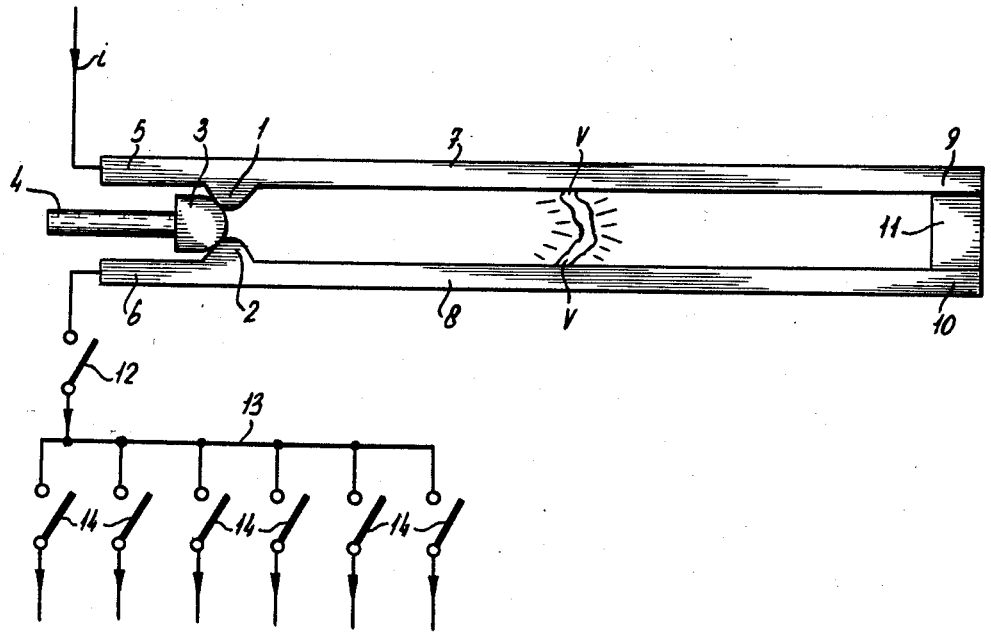

FIG. 1 illustrates the first embodiment comprising a system of contacts consisting of two stationary contacts 1 and 2 provided with terminal current-conducting means 5 and 6 and a third contact 3 movable under the influence of a mechanism (not illustrated) towards and away from the stationary contacts by means of rod 4. Contact 3 may, thus, electrically connect or separate stationary contacts 1 and 2. Conducting members 7 and 8 extend from the stationary contacts 1 and 2 respectively; the ends 9 and 10 of conducting members 7 and 8 remote from the contacts 1 and 2 are electrically connected with each other by the connecting device or end member 11. The device according to the first embodiment of the invention can be inserted in a current distributing system comprising the main switch 12 connected to the bus bar 13 onto which the group of switches 14 are connected. The main switch 12 and the group of switches 14 are provided with an overload relay or over-current release mechanism, so that the switches may interrupt the flowing current themselves when the current, as a consequence of an overload, exceeds a certain value. The response time of the switches 12 and 14 is set such that when an overload occurs in one of the outgoing groups, whereby an overload current will flow through switch 14 and through the main switch 12, switch 14 will respond sooner than the main switch 12.

Consequently, switch 14, in the group in which overload occurs, will interrupt the overload current as a result of which the main switch 12 will not interrupt the current, and the other groups of switches will remain connected with the current source through the main switch 12 and the switches 14.

When the device according to the first embodiment of this invention is connected in series with the main switch 12 (as illustrated in the first embodiment) the process is as follows:

As soon as an overload current occurs, the movable contact 3 is quickly withdrawn via an electromechanical over-current release, the rod 4 by mechanism; as a result of which two arcs are formed between the stationary contacts 1 and 2 on the one hand and the movable contact 3 on the other hand. The arcs, under the influence of the magnetic field generated by the current flowing successively through members 5, 1, 3, 2 and 6, will move towards conducting members 7 and 8 and soon these two arcs will unite in one arc, that arc with its arc roots V travelling away from the stationary contacts 1 and 2 along the conducting members 7 and 8 towards the ends 9 and 10 under the influence of the magnetic field generated by the current flowing through the conducting member 7 and 8.

The arc is always electrically in parallel with the impedance of the series connection of the section of the conducting member 7 lying between the arc root V of the arc and the end 9, the connecting end member 11 and the section of the conducting member 8 lying between the end 10 and the other arc root V of the arc.

Apart from the impedance of the electric distributing system the following parts are serially connected with the arc: the impedance of successively the terminal current-conducting part 5, the stationary contact 1 and, particularly, the section of the conducting member 7 lying between the stationary contact 1 and arc root V of the arc, as well as the impedance of successively the terminal current-conducting part 6, stationary contact 2 and, particularly, the section of the conducting member 8 lying between base V and the stationary contact 2.

With the continuous movement of the arc towards the ends 9 and 10 of the conducting members 7 and 8, the impedance in series with the arc will increase, as a consequence of which the total impedance of the total electric circuit will increase and the current flowing through the electric circuit will be reduced, and the impedance connected in parallel with the arc at the right of the arc in FIG. 1 will decrease. Because the current flowing through the electric circuit will reduce as a result of which the arc energy will decrease while the load of the voltage across the arc will increase as a consequence of the decrease of the aforementioned impedance connected in parallel with the arc, the arc will be quenched before it has reached the ends 9 and 10.

Thus, in this way, impedance is introduced in the electric circuit by the travelling arc, whereby the current flowing through the circuit is reduced, whereupon the current may be interrupted by a switch 12 or 14 connected in series with the device according to the invention, the switch having a comparatively limited circuit-breaking capability.

Figure 2:
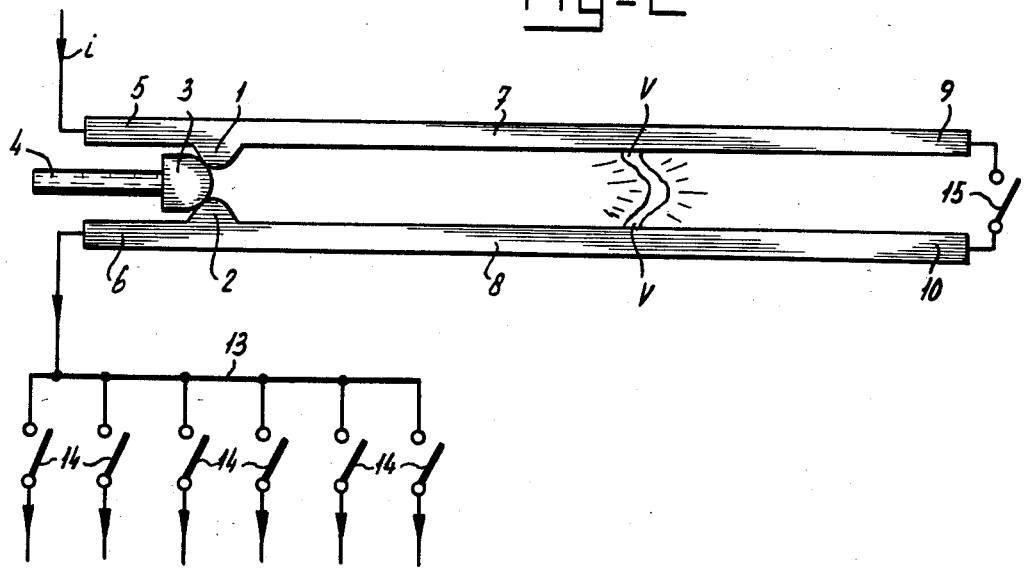

The embodiment illustrated in FIG. 2 differs from the embodiment illustrated in FIG. 1 only in that the connecting device or end member 11 has been omitted and that, instead thereof, the ends 9 and 10 of the conducting members 7 and 8, respectively, are connected with the switch 15 illustrated diagrammatically in FIG. 2. The functioning of the device according to this embodiment is similar to that of the aforementioned embodiment of FIG. 1. The difference is that when the arc has been quenched the current may be interrupted by switch 15, which, as opposed to the switches 12 and 14 illustrated in FIG. 1, need not be capable of conducting the prolonged flow of the nominal current through the electric circuit, but it should only conduct the flow of part of the current during the presence of the arc after withdrawal of the movable contact 3 via portion 4 and the flow of the current for a short period of time when the arc has been quenched and the subsequent cutting off of the reduced current. The switch may, thus, be simple construction. With the introduction of the switch 15 according to the embodiment of FIG. 2, switch 12 illustrated in FIG. 1 can be omitted and switch 15, in co-operation with the contact system 1, 2, 3 may operate as such.

Switch 15 illustrated in FIG. 2 may be successfully replaced by a safety fuse which, of course, should be of such so slow action that when an overload occurs at one of the switches 14 remote from the current source, switch 14 will interrupt the current before the safety fuse does.

It is also evident that safety fuses may be accommodated in the electric circuit instead of switches 14.

Finally, it is noted that the device in accordance with the present invention can be used quite well to limit the necessary short-circuit capacity of a transformer when the device has been connected in series with that transformer. This applies as well to any converters connected at the output side of the device, e.g. to rectifiers and the like. The device according to the invention may, thus, take the place of a choke.

Conducting members 7 and 8 may be mounted in the open atmospheric air or may have been disposed in a body of insulating material, such as in the aforementioned British patent.

For illustrative purposes a few parameters of a device of the present invention as tested in the laboratory are given below.

Arc conductors disposed in atmospheric air.

| | | |
|---|---|---|
| Length between the arc conductors | 0.650 | m |
| Air gap between the arc conductors | 0.020 | m |
| Air gap between the stationary contacts | 0.005 | m |
| Resistance of the conductors | 45 | milli ohm/ conductor |
| Impedance of the circuit | 100 | milli ohm |
| A. Voltage | 1000 | volt eff. |
| peak value of the current with closed contacts | 10 | k a |
| peak value of the current with open contacts | 8,65 | k a |
| B. Voltage | 2000 | v eff. |
| peak value of the current with closed contacts | 20 | k a |
| peak value of the current with open contacts | 15,55 | k a |

In the case of A a current limitation was achieved from 10 k a to 8.65 k a and in case B even from 20 k a to 15.55 k a!

I claim:

1. A device for limiting electric current in a current interruption device, comprising:

two stationary contacts including terminal means and a bridging contact movable toward and away from a position bridging said stationary contacts;

a conductor connected to each of said stationary contacts;

said bridging contact moving away from said bridging position at a value of the current flowing through said conductors such that upon interruption of the current therethrough the voltage across said stationary contacts is sufficient to generate an arc therebetween, said arc traveling along said conductors away from said stationary contacts by the magnetic field generated from the current flowing through said conductors; and means interconnecting the ends of said conductors remote from said stationary contacts to provide a parallel current path for said arc, and including means for interrupting said current from the terminal means to said arc.

2. Device accordance with claim 1 wherein said end member is a stationary through-connection.

3. Device in accordance with claim 1 wherein said end member is an interrupter.

4. Device in accordance with claim 3, wherein said interrupter is an electrical switch.

5. Device in accordance with claim 3, wherein said interrupter is an electrical safety fuse.

6. A device for limiting electric current in a current interruption device, comprising:

two stationary contacts including terminal means and a bridging contact movable toward and away from a position bridging said stationary contacts;

a conductor connected to each of said stationary contacts;

said bridging contact moving away from said bridging position at a value of the current flowing through said conductors such that upon interruption of the current therethrough the voltage across said stationary contacts is sufficient to generate an arc therebetween, said arc traveling along said conductors away from said stationary contacts by the magnetic field generated from the current flowing through said conductors; and means interconnecting the ends of said conductors remote from said stationary contacts to provide a parallel current path other than that for said arc, and including means for interrupting said current flowing through said conductors.

* * * * *